United States Patent [19]

Graves

[11] 3,953,932

[45] May 4, 1976

[54] CASINO CHIP AND METHOD OF MAKING

[76] Inventor: John W. Graves, 6838 E. Coronado Road, Scottsdale, Ariz. 85257

[22] Filed: Feb. 18, 1975

[21] Appl. No.: 550,674

[52] U.S. Cl. ..... 40/27.5; 156/303.1

[51] Int. Cl.[2] ..... G09F 3/02

[58] Field of Search..... 40/27.5, 10 R; 264/246, 264/247; 428/64, 67; 156/303.1, 293; 29/159.2; 63/23

[56] References Cited

UNITED STATES PATENTS 478,304 7/1892 Alvord ..... 40/27.5

3,350,802 11/1967 Segel ..... 40/27.5

*Primary Examiner*—Louis G. Mancene
*Assistant Examiner*—John H. Wolff
*Attorney, Agent, or Firm*—A. Yates Dowell, Jr.

[57] ABSTRACT

A game or casino chip integrally formed of several distinct layers of moldable thermoplastic materials each of which is at least partially visible on a portion of the exterior surface of the chip and each of which may selectively include various characteristics, indicia or design features, and a method of manufacturing the same in a multi-step molding operation.

3 Claims, 10 Drawing Figures

CASINO CHIP AND METHOD OF MAKING

BACKGROUND OF THE INVENTION

1. Field of the Invention

The invention relates generally to molded articles of thermoplastic material such as those commonly referred to as casino or poker chips and their method of manufacture, and relates particularly to a chip which is integrally formed of a plurality of separate portions which are at least partially displayed along a portion of the exterior of the chip and which selectively include various indicia or design features which are unique to the identity of the chip, as well as to the method of constructing such a chip by a multi-staged molding operation.

2. Description of the Prior Art

While the invention can be employed to advantage in the production of premium chips for product advertising, bottle caps, receptacle covers, and the like, it is of particular advantage in the production of chips commonly referred to as poker or casino chips. In the various establishments wherein chips are used in the normal conduct of business to represent various monetary or purchasing values, the problem of chip counterfeiting or substitution has been continuous. In such environments the use of the standard or commonly known game checks or chips which are of a simple, one-piece wood, plastic or metal construction has not been practical.

One current practice in the production of poker or casino chips is the placement of various identifiable marks on a single-layer molded plastic chip either during the molding operation or subsequent thereto. Single-layer chips, however, are easily altered or reproduced and are therefore often not satisfactory.

Another identifying technique includes the addition of paper or plastic disks to the top and bottom surfaces of the chip. These disks are normally printed, embossed or otherwise marked with various indicia which will reflect the value or origination of the chip. It is frequently possible to remove these disks and thereafter substitute counterfeit disks in order to increase the face value of the chip. Other multi-layered chips or coins have been used in which a paper disk is inscribed and/or colored to indicate its identity value and subsequently adhesively secured between transparent layers of a secondary material.

One of the preferred methods practiced today to prevent counterfeiting of casino chips is to mold the basic chip in a first color and provide different colored sections along the edge of the chip which normally identifies the value of the chip even when the chips are stacked. Each denomination of chip usually has a color combination which is different from other denominations. In such a process, multiple wedges or sections are removed from a previously molded chip, after which other wedges or sections of a different colored material are molded or otherwise secured in the cutout portions of the chip. Counterfeiting is again a problem, however, since the distinctively colored wedges or sections of the chip can be removed and replaced with other sections of a different color.

Other methods which have been employed for facilitating the identity of particular chips include silk screening and hot stamping as post-molding operations.

Some examples of the prior art include Ser. Nos. 478,304 to Alvord and 447,556 to Beyer; and U.S. Pat. Nos. 2,298,365 to Gits et al; 2,544,140 to Dofson et al; and D. 150,099 to Taylor et al.

Summary of the Invention

This invention is embodied in a game or casino chip of the type commonly referred to as a poker or casino chip and the method of manufacturing the same in a multi-staged molding process including two separate injection molding operations. The chip is integrally constructed having a distinctively colored central or intermediate portion of a first thermoplastic material around which an outer portion or body of a second thermoplastic material is molded in such a manner that portions of the central portion are at least partially visible through or along the upper and lower walls and the edge of the chip. The chip may further include a pair of third inserts of moldable thermoplastic material which is molded flush with the upper and lower walls thereof.

It is the primary object of the invention to provide a multi-layered game or casino chip which is easily identifiable by the distinctive colors and/or markings associated with the respective layers.

Another object of the present invention is to provide an inexpensive process for the manufacture of a plurality of casino chips having distinctive markings, designs and color combinations.

A further object of this invention is to provide a process of molding a casino chip including the steps of injection molding the central portions and outer portions of the chip in such a manner that such portions are uniquely displayed and yet integrally combined.

It is another object of this invention to provide a casino chip constructed of a plurality of distinct materials in such a manner as to be a deterrent to the unauthorized duplication thereof.

BRIEF DESCRIPTION OF THE DRAWINGS

With continued reference to the drawings, the poker or casino chip 20 of this invention is generally disk shaped having substantially parallel upper and lower walls 21 and 22, respectively, connected by a side wall or edge 23. As illustrated in FIG. 1, the chip preferably includes a variety of decorative markings or symbols 24 on the upper and lower walls as well as advertising or identification indicia 25. The casino chip is constructed of three separate layers or portions which are combined to form the finished chip. With reference to FIGS. 2 and 3, the chip has a central or intermediate portion 26, a body or outer portion 27, and upper and lower identification portions 28 and 28*a*, respectively.

Figure 2:
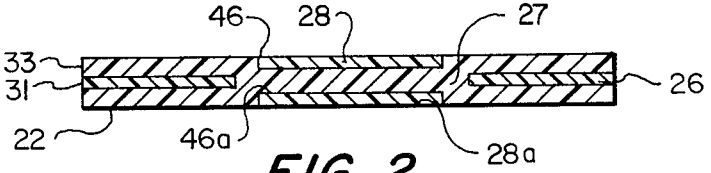
FIG. 2 is an enlarged section on the line 2—2 of FIG. 1.

The portions 26, 27, 28 and 28*a* are formed of moldable thermoplastic material, and it is preferable that the portions 26 and 27 be injection molded utilizing different colors of thermoplastic material, so that a color contrast is developed between such portions. In some instances, it may be desirable that the portions vary in their respective light transmitting properties, such as providing a transparent outer portion 27 through which a more opaque intermediate portion 26 is visibly displayed.

With particular reference to FIGS. 1–4 and 6, the intermediate portion 26 has a generally flat disk-like member 29 with a centrally disposed opening 30 and segmented outer walls 31. Although it is possible for the outer walls 31 to be connected to form a completely circular shape, it is preferred, for reasons to be discussed later, that they be separated by a plurality of slots or keyed areas 32. Although the slots 32 are shown as diverging from the outer wall 31 inwardly, various other shapes may be suitable. The body or outer portion 27 is formed integral with or fused to the intermediate portion 26 and has an edge wall 33 of substantially the same diameter as the wall 31. Therefore, when the chip is molded, the edge wall 33 of the outer portion is substantially coextensive with the outer walls 31 of the intermediate portion so that the edge 23 of the chip is a composite band which displays segments of both portions.

As previously discussed, the intermediate and outer portions may be formed of plastics having varying properties of light transmitivity with the outer portion 27 being formed of a transparent plastic and the intermediate portion 26 being relatively more opaque. In such instances, it is not necessary that the outer wall 31 of the intermediate portion be coextensive with the edge wall 33 of the outer portion, only that it be visually displayed through the edge 23 of the chip.

Figure 1:
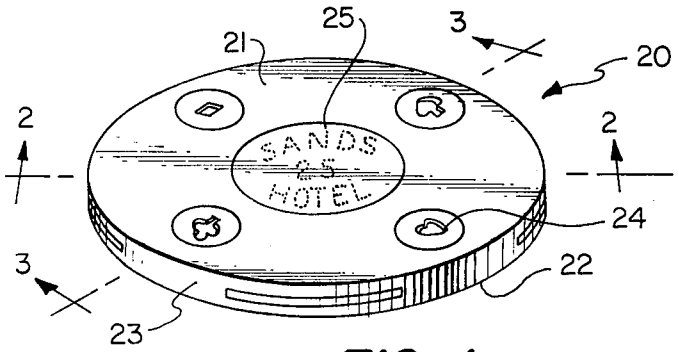
FIG. 1 is a perspective illustrating one application of the invention.
Figure 4:
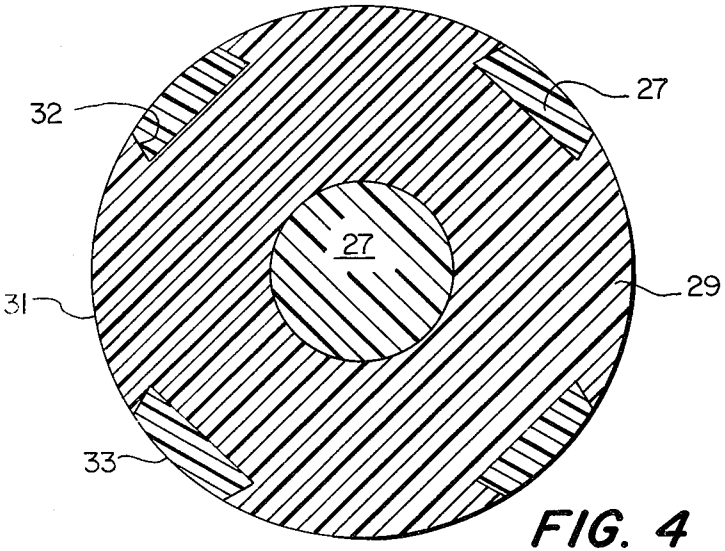
FIG. 4 is a section on the line 4—4 of FIG. 3.
Figure 7:
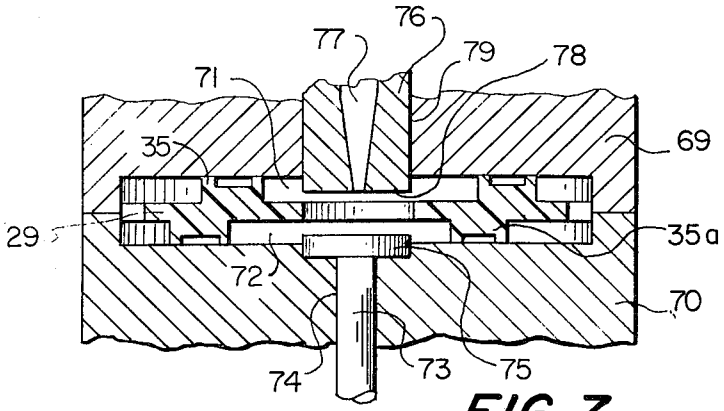
FIG. 7 is a section of the mold for forming the outer portions of the chip.

The intermediate portion of the chip also includes a plurality of upwardly and downwardly extending projections 35 and 35*a* which are integrally formed along the upper and lower surfaces of the disk-like member 29, respectively. Although the projections 35 are shown as being cylindrical, various other shapes may be used as desired. Although four of such projections are shown in FIG. 1, it is noted that any desired number can be used. It is contemplated that a single projection formed in a continuous band which extends outwardly from each side of the intermediate portion can be provided. It should also be pointed out that though the projections 35 and 35*a* are shown in FIG. 3 as being vertically aligned, it is possible that they may be formed in a staggered arrangement, such as shown in FIG. 7.

The outer face of each of the projecting elements preferably is coplanar with the respective upper and lower walls 21 and 22 of the chip. However, in some instances such as when the outer portion 27 is transparent, it may be advantageous or desirable for the projections not to extend to the upper and lower walls of the chip but only be viewable therethrough.

Various symbols or designs 24 which may or may not serve a functional purpose in identifying, coding or valuing a particular chip are formed on the outer face of each of the projections 35. In the drawing, such designs are depicted as being the symbols of a heart, diamond, club, and spade, which are commonly used to distinguish playing card suits. Although the symbols 24 are shown in the drawings as being depressions in the ends of the projections 35, it is apparent that such symbols may be etched, stamped, stenciled or printed thereon, and that the symbols may be selectively colored to contrast with the other portions of the chip.

Figure 3:
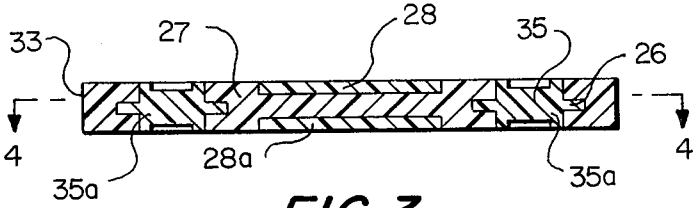
FIG. 3 is an enlarged section on the line 3—3 of FIG. 1.

As shown in FIGS. 1–3, the intermediate portion 26 is enclosed within the body or outer portion 27 except for those portions of the wall 31 which is coextensive with the edge wall 33 of the outer portion and the outer faces of the projections 35 and 35*a* which normally are coextensive with the upper and lower walls 21 and 22. A pair of opposed recesses 46 and 46*a* are located in the upper and lower walls 21 and 22 into which the identifying disks 28 and 28*a* can be secured.

With reference to FIG. 2, the thin identifying disks 28 and 28*a* may be manufactured using distinctively colored plastic materials which are etched, engraved, or otherwise marked on their outer faces with symbols, designs or other indicia 25 which may be peculiar to the value or use of the chip. Such a disk is shown in FIG. 1 as having on its outer face the inscription "Sands Hotel — $25".

The identifying disks 28 and 28*a* are secured within the recesses 46 and 46*a* of the chip in any desired manner as by utilizing ultrasonic vibrations, adhesives, or the like.

Figure 10:
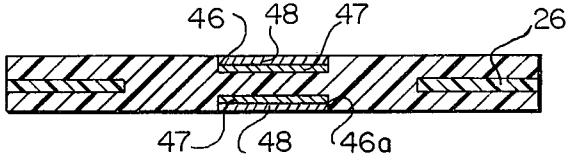
FIG. 10 is a section of another embodiment of the chip.

An alternate method for placing the indicia 25 on the chip is shown in FIG. 10. In this embodiment of the invention, labels, insignia, or other indicia is printed or inscribed on a thin disk 47. One of such disks is first placed within each of the recesses 46 and 46*a* after which a layer 48 of transparent thermoplastic material is molded or adhered to the disk and the edges of the recesses 46 and 46*a* to insure that the recesses are filled flush with the respective upper and lower walls of the chip as well as prevent the removal of the indicia disks.

The effect of combining several colors of thermoplastic material to form a composite chip is that the chip can be easily distinguished in a variety of ways in order that the ownership and/or value thereof can be quickly determined and the unauthorized duplication thereof prevented. It is immediately apparent that different color combinations can be used to identify the values or worth of the chip. It is also possible, however, to use the physical relationship between the types, colors, sizes, and disposition of the edge 23 and the faces of the projections 35 and 35*a* to identify the chip. Alternatively, the design carried on the outer ends of the projections and identification disks can also be used to indicate value or identity.

The construction of the composite chip is also an added defense against the possible alteration thereof. Because the chip includes an intermediate portion which is partially displayed along the upper and lower walls as well as edge of the chip, it is difficult to drill, cut, or otherwise tamper with the chip without leaving some visual indication of such an effort.

In the manufacture of the composite chip it is necessary to insure that the separate portions of the chip are effectively combined to provide a chip which is esthetically pleasing, easily identifiable, and which offers the user security against the alteration or copying of the finished chip. Further, the process of manufacture should be as inexpensive as possible and yet be easily and quickly adaptable to vary the colors, sizes, identifying and decorative marks or designs which may be used in a particular chip.

The production of the present casino chip by a unique molding process offers such advantages. With specific reference to FIGS. 5–9 of the drawings, the molding process will be discussed in greater detail.

Figure 5:
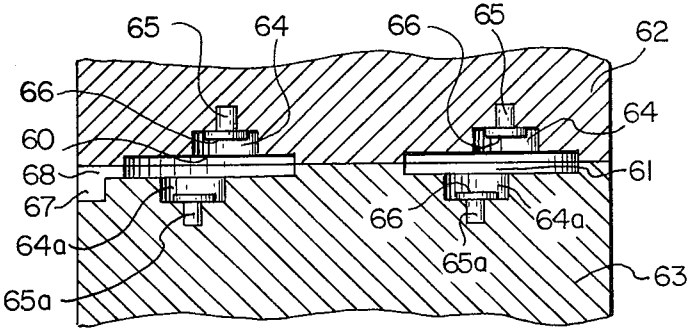
FIG. 5 is a section of the mold for forming the intermediate portion of the chip.

With particular reference to FIG. 5, the intermediate portion 26 is formed in a one-step injection molding process within cavities 60 and 61 of upper and lower injection molding dies or forms 62 and 63, respectively. Each of the cavities 60 and 61 is generally annularly shaped having portions along its outer edge which are filled in to form the means by which the slots 32 are created along the outer wall of the central layer during the molding operation. Such filled in portions may be varied in number, size and in relative displacement from one another in order to provide any desired number or spacing of the exposed areas of the outer walls 31 of the intermediate portion which are visible along the edge of the chip.

Figure 6:
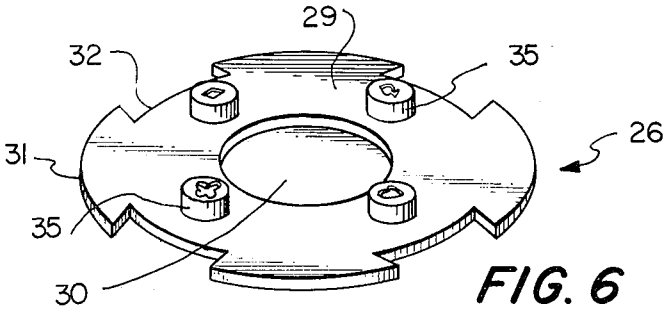
FIG. 6 is a perspective of the intermediate portion of the chip.
Figure 8:
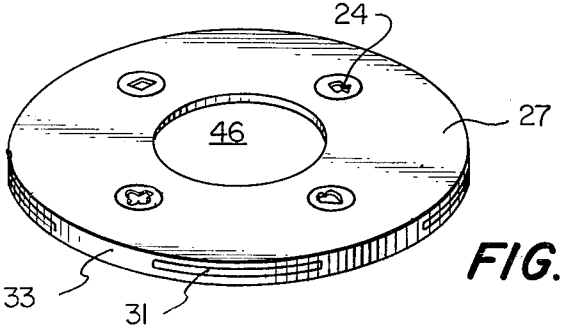
FIG. 8 is a perspective of a partially formed chip.

In order to integrally form the projections 35 and 35*a* along the respective upper and lower surfaces of the intermediate portion, a plurality of second cavities 64 and 64*a* are provided in the molding forms which communicate with the first cavities 60 and 61 respectively. The number and shape of these second cavities may vary depending upon the number and shape of the projections 35 and 35*a* which it is desired to provide in the finished chip. The symbols 24 in the outer faces of the projections are created by placing pins 65 and 65*a* within the second cavities 64 and 64*a*. Each of the pins 65 and 65*a* includes an outer molding element 66 which may be of any desired shape such as a heart, diamond, club, and spade or the like as shown in FIGS. 6 and 8.

In an alternate form of the invention which is not shown, it is contemplated that the pins 65 or 65*a* could include molding cavities instead of the elements 66 so as to allow the symbols 24 on the projecting element to be raised. Such raised symbols are desirable if only the symbol is to be visibly displayed along the upper and lower walls of the chip.

When the upper and lower mold forms 62 and 63 are assembled, communication with the molding cavities in provided by a gate 67 and passageway 68. In order to mold the intermediate portion, as shown in FIG. 6, the mold forms are connected through gate 67 and passageway 68 to a suitable injection molding machine and molten thermoplastic material is injected at elevated temperature and pressure into the molding cavities. When the thermoplastic material is sufficiently solidified, the intermediate portion 26 is withdrawn from the mold and any sprue-like projections or flashing is removed.

After the initial molding process, the intermediate portion 26 is placed into the cavity of a second injection mold. This second mold includes upper and lower mold dies or forms 69 and 70 having opposed generally circular molding recesses 71 and 72 therein. When the molding forms 69 and 70 are assembled, the cavity formed by the recesses 71 and 72 corresponds to the desired size of the finished chip.

As illustrated best in FIG. 7, the second mold includes a knockout pin 73 which extends through an opening 74 in the lower mold form 70. An enlarged head 75 is provided on the end of the pin 73 and extends into and is substantially centered within the lower molding recess 72. An injection nozzle 76 having a centrally disposed fluid passageway 77 and molding end 78 extends through an opening 79 in the upper mold form 69. The injection nozzle has a conventional gate (not shown) to control the flow of thermoplastic material therethrough. The nozzle 76 is located substantially in vertical alignment with the head 75 of the knockout pin 73, and the molding end 78 which extends into the upper molding recess 71 is substantially the same size and shape as the knockout pin head 75. Although it is preferred that the shape of the knockout pin head 75 and the nozzle molding end 78 be circular, any other shape may be used as desired.

In order to mold the outer portion 27 over the intermediate portion 26, such intermediate portion is first placed in the recesses 71 and 72 of the second mold. When the upper and lower molding dies or forms 69 and 70 are assembled, the outer wall 31 of the intermediate portion 26 normally engages the vertical molding wall 80 defined by the recesses 71 and 72. Also, the outer faces of the projections 35 and 35*a* of the intermediate portion are in abutting relationship with the bottoms of the recesses 71 and 72 of the upper and lower molding forms.

After the intermediate portion 26 has been inserted in the second mold, molten thermoplastic material of a different color than the thermoplastic material used in the production of the intermediate portion is injected at elevated temperature and pressure through the nozzle 76 into the mold recesses filling the areas not occupied by the central layer. When the second material has set, the mold is opened and the knockout pin is raised to discharge the chip from the lower mold form 70. The chip, as shown in FIG. 8, is now ready to have the identifying layer molded into the recesses 45 and 45*a* which have been formed in the upper and lower surfaces of the chip by the molding end 78 of the nozzle and head portion 75 of the knockout pin during the second molding operation.

Figure 9:
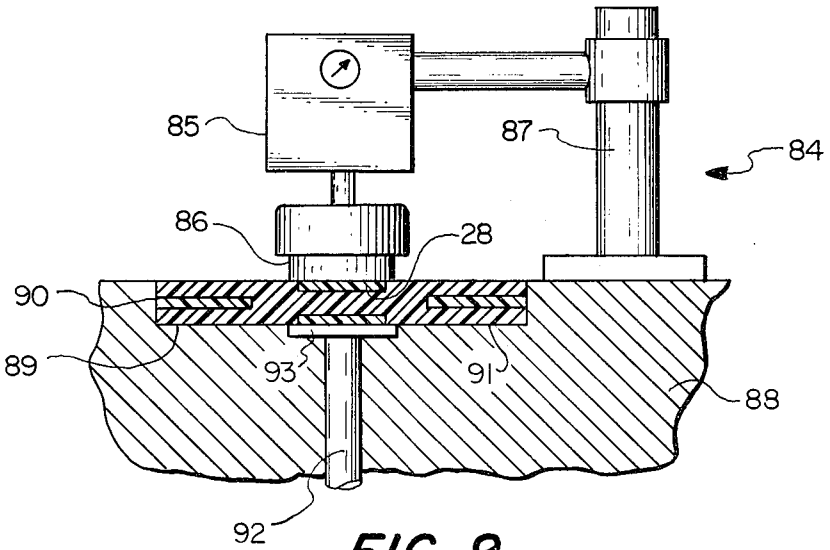
FIG. 9 is a reduced scale section of a completed chip with the apparatus for completing the same in side elevation.

As previously discussed, the identifying layers 28 and 28*a* are preferably molded in the recess 46 and 46*a* of the chip by a method utilizing ultrasonic vibrations. With reference to FIG. 9, the ultrasonic molding apparatus 84 includes a conventional transducer 85 having a depending horn 86. The transducer is supported by a standard 87 above a molding base 88. The molding base includes a chip receiving recess 89 having a peripheral wall 90 and a bottom wall 91. A knockout pin 92 extends through the base 88 and includes an enlarged head member 93 which normally is flush with the bottom wall 91 of the recess 89 during the molding process.

A pair of thin disks 28 and 28*a* of distinctively colored thermoplastic such as those previously discussed as being suitable for the identification layer, are inserted in each of the recesses 46 and 46*a* of the chip. The chip is placed in the recess 89 of the molding base and the transducer 85 is lowered to cause the horn 86 to move into contact with the upper disk 28 so that when the transducer is energized, the heat and pressure created by the ultrasonic vibrations causes both of the disks 28 and 28*a* to be welded to the poker chip so that the upper faces of the disks 28 and 28*a* are flush with the top and bottom walls of the poker chip. The transducer then is raised and the knockout pin 92 is actuated to remove the chip.

What is claimed is:

1. A casino chip comprising an intermediate portion having a peripheral wall and a central opening, a plurality of spaced notches disposed along said peripheral wall, said intermediate portion having at least one projection extending outwardly from each side, each of said projections having an outer face, an outer portion fused to opposite sides of said intermediate portion and extending through the central opening thereof and each of said notches, said outer portion having a peripheral wall through which the peripheral wall of said intermediate portion is visible, said outer portion being substantially flush with the outer faces of said projections so that said outer faces are visible, said outer portion having opposed recesses, an indicia carrying disk fixed within each of said recesses, and said intermediate portion and said outer portion being of different colors, whereby a plurality of colors are visible on opposite sides and along the edge of the casino chip.

2. The structure of claim 1 in which the peripheral wall of said intermediate portion and the peripheral wall of said outer portion are substantially co-extensive.

3. The structure of claim 1 in which the outer faces of said projections include decorative recesses.

* * * * *